United States Patent [19]

Koenig

[11] Patent Number: 4,977,704

[45] Date of Patent: Dec. 18, 1990

[54] MACHINE SHED SLIDING DOOR OPERATOR

[76] Inventor: Gordon K. Koenig, 10540 11th Ave. N.E., Rochester, Minn. 55906

[21] Appl. No.: 511,731

[22] Filed: Apr. 23, 1990

[51] Int. Cl.[5] ..... E05F 11/34

[52] U.S. Cl. ..... 49/362

[58] Field of Search ..... 49/362, 360, 324, 409, 49/410

[56] References Cited

U.S. PATENT DOCUMENTS

| | | | |
|---|---|---|---|
| 1,018,442 | 2/1912 | Burgess . | |
| 1,057,547 | 1/1913 | Heimer . | |
| 1,355,874 | 10/1920 | Wheeler et al. . | |
| 1,917,415 | 7/1933 | Woodruff . | |
| 1,997,175 | 4/1935 | Gussack . | |
| 3,436,863 | 4/1969 | Peelle, Jr. et al. | 49/362 |
| 3,996,697 | 12/1976 | Bailey et al. | 49/362 X |
| 4,409,905 | 10/1983 | Zerbi | 49/362 X |
| 4,541,202 | 9/1985 | Dockery . | |

*Primary Examiner*—Philip C. Kannan

*Attorney, Agent, or Firm*—Palmatier & Sjoquist

[57] ABSTRACT

The present machine shed sliding door operator utilizes a gear and motor arrangement which rides back and forth with the machine shed sliding door when the sliding door is flopped back and forth against the shed by wind. The gear and motor arrangement slides in a stationary frame rigidly affixed in an upper corner of the door frame and continuously brings pressure to bear on a gear rack set in the door. A continuous meshing pressure on the gear rack by the gear arrangement is created by coil springs continuously pushing the gear arrangement against the gear rack.

10 Claims, 3 Drawing Sheets

MACHINE SHED SLIDING DOOR OPERATOR

The present invention relates to sliding door operators and more particularly to door operators for machine shed sliding doors.

BACKGROUND OF THE INVENTION

A machine shed sliding door is a door of a relatively large size for sheds in which massive implements such as combines and tractors are housed. The doors are typically hand operated and slide parallel to a wall of the shed via rollers which are bolted to the top edge of the door and which ride in a track affixed to the shed or via pulleys which ride on a rail.

Wind is a nuisance in the operation of machine shed sliding doors. Whether the doors are wooden or steel, the doors have relatively large surface areas and are readily flopped back and forth by the wind. When the doors are open, high winds may either directly propel the door against the shed or create a suction between the door and the shed to drive the door against the shed.

SUMMARY OF THE INVENTION

A feature of the present invention is the provision in a machine shed sliding door operator, of a stationary frame fixed in an upper corner of a door frame with a door operating means transversely movable relative the stationary frame and to and away from the shed and bearable and continuously biased against the door so as to operate the door when the wind flops the door back and forth.

Another feature of the present invention is the provision in such a machine shed sliding door operator, of a door operating means transversely slidable in the stationary frame toward and away from the shed and including resilient means connected between the stationary frame and a gear and motor arrangement so that the gear and motor arrangement continuously bears against the door whether the wind drives the door to or away from the shed.

Another feature of the present invention is the provision in such a machine shed sliding door operator, of a rack set in the door for cooperating with a toothed gear slidably and transversely mounted relative to the stationary frame.

Another feature of the present invention is the provision in such a machine shed sliding door operator of an automatic switch may be correlated to the width of the door so as to be readily adjustable for doors of different widths.

An advantage of the present invention is that it is operable even in high winds when the door is being driven toward and away from the shed.

Other advantages of the present invention are that it is readily adjustable for different door lengths, automatically turned off at the opened and closed positions, relatively inexpensive to manufacture, and simple to install, operate and repair.

DETAILED DESCRIPTION OF THE PREFERRED EMBODIMENT

Figure 1:
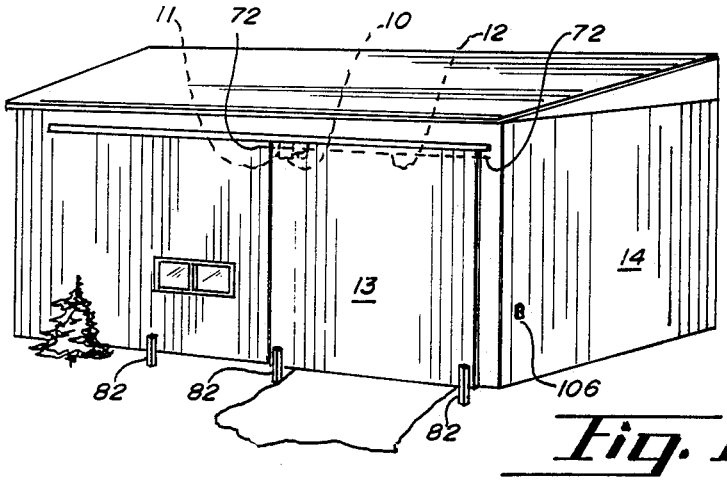
FIG. 1 is a perspective view of a machine shed with the door operator shown in phantom in a corner of the door frame.
Figure 2:
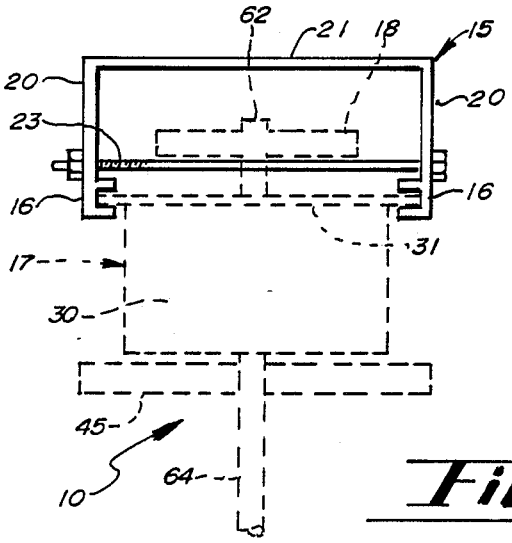
FIG. 2 is a front elevation, partially phantom view of the door operator of FIG. 1 with a stationary portion of the door operator shown in solid lines and a slidable portion of the door operator shown in phantom.
Figure 3:
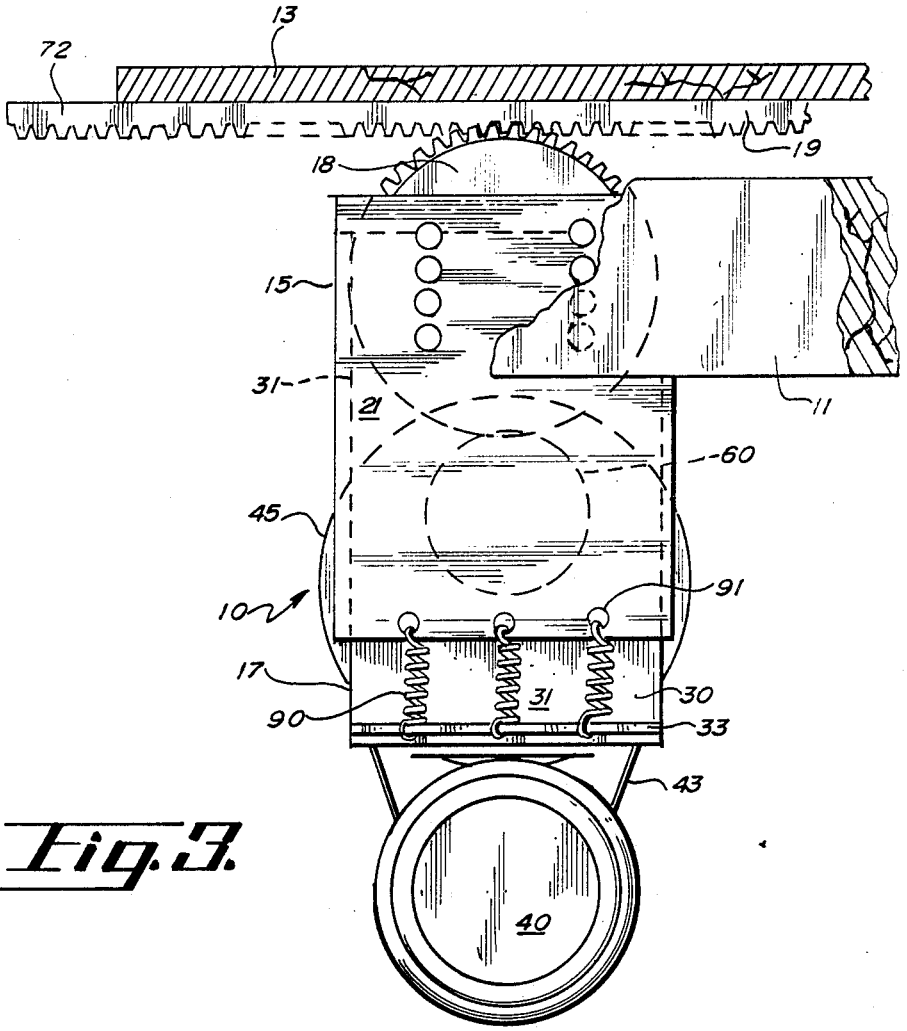
FIG. 3 is a top elevation, partially sectional and phantom view of the door operator of FIG. 2 with a portion of the door operator bearing against another portion of the door operator which is set in the sliding door.
Figure 4:
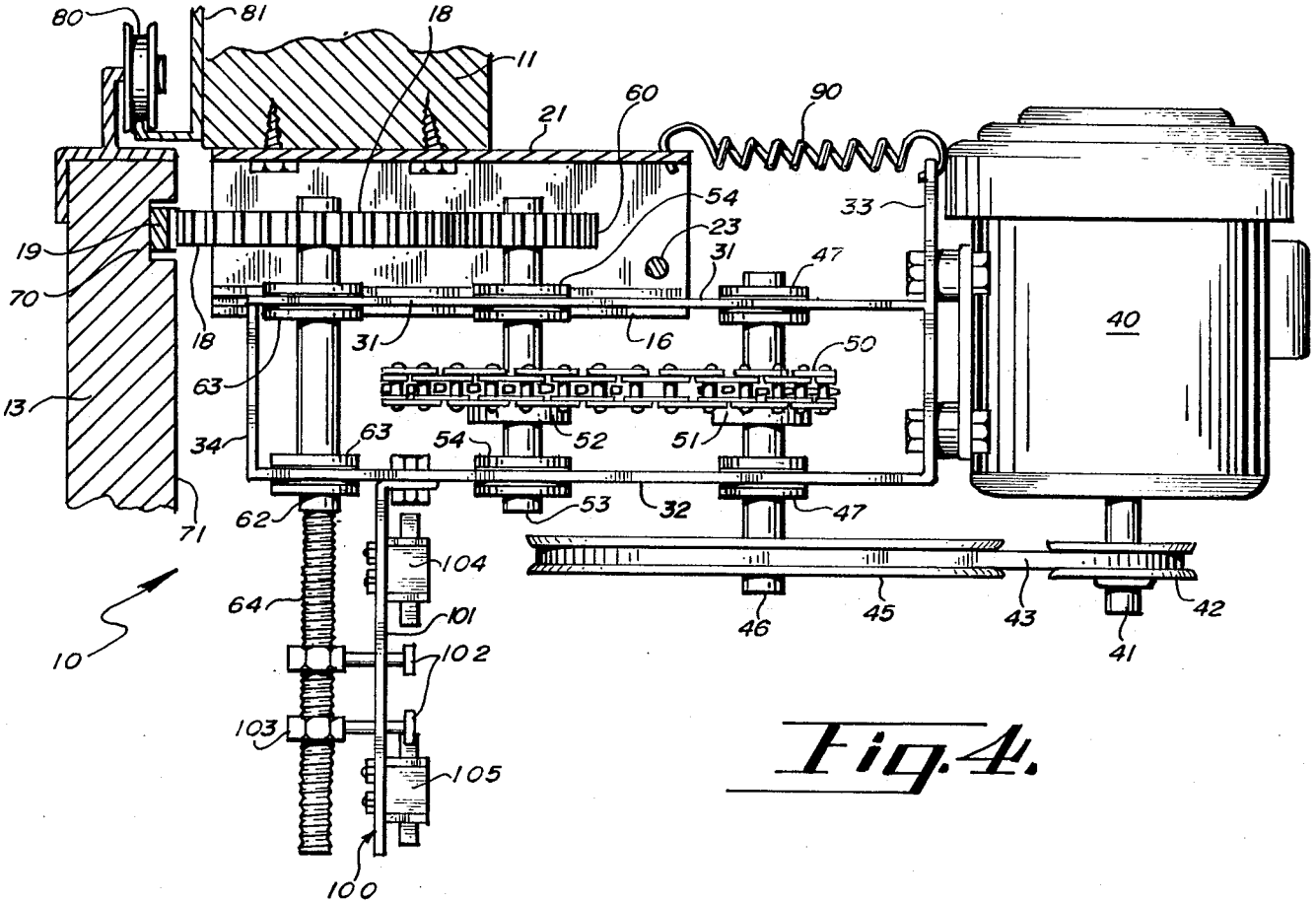
FIG. 4 side elevation, partially sectional view of the door operator of FIG. 3.

As shown in FIG. 1, a machine shed sliding door operator is generally designated by the reference numeral 10 and is typically affixed to an upper corner 11 of a door frame 12 for opening a sliding door 13 of a machine shed 14. As shown in FIG. 2, the door operator 10 includes as its principal components a stationary frame 15 with U-channels 16, and a door operating means or a gear and motor arrangement 17 which is slidably mounted in the U-channels 16. As shown in FIGS. 3–4, the gear and motor arrangement 17 includes a spur gear 18 which meshes with a gear rack or engaging means 19 affixed in the door 13.

The stationary frame 15 is generally U-shaped and includes a pair of side plates 20 and a top plate 21 rigidly affixed to and between the sides 20. Each of the bottom portions of the sides 20 includes one of the U-channels 16 which extend inwardly toward each other and which run transversely relative to the door 13. One of the purposes of the U-channels 16 is to slidingly mount the gear and motor arrangement 17. The frame 15 includes a rod 23 affixed to and between rear portions of the sides 20 to prevent the sides 20 from spreading under the weight of the sliding gear and motor arrangement 17.

The gear and motor arrangement 17 includes a sliding, box-like frame 30 with an over-sized upper horizontal plate 31 which is slidingly mounted in the U-channels 16. The frame 30 also includes a lower plate 32 with a width less than the width of the top plate 31, a back, vertical plate 33 which extends upwardly beyond the top plate 31, and a front plate 34. The plates 31–34 are rigidly affixed to each other to form the box-like sliding frame 30.

An electric motor 40 is bolted to the rear plate 33. The motor drives a shaft 41 to which a first pulley is affixed. The first pulley 42 drives a belt 43 which in turn drives a second pulley 45. The second pulley 45 has a larger diameter than the first pulley 42. The pulley 45 is affixed to a shaft 46 which is rotatably mounted to the upper and lower plates 31, 32 via bearings 47.

A first sprocket 50 is affixed to the shaft 46 between the upper and lower plates 31, 32 and drives a chain 51. The chain 51 drives a second sprocket 52 which has a larger diameter than the first sprocket 50. The second sprocket 52 is affixed to a shaft 53 which is rotatably mounted to upper and lower plates 31, 32 via bearings 54.

A smaller spur gear 60 is affixed to a top portion of shaft 53 and meshes with and drives the larger spur gear 18. Spur gear 18 is affixed to a shaft 62 which is rotatably mounted to upper and lower plates 31, 32 via bearings 63. The shaft 62 includes a bottom, threaded portion 64.

The larger spur gear 18 meshes with and drives the gear rack 19. The gear rack 19 is affixed in a top, inside, longitudinal portion 70 of the sliding door 13. The gear rack 19 is set in the door 13 as to lie substantially flush with an inside face 71 of the door 13. The gear rack 19 includes integral end portions 72 which extend typically about six inches past each end of the door 13 so that the door 13 may be fully opened so as to expose the door frame 11 or so as to be completely closed.

The sliding door 13 may be supported relative to the shed 14 via a pulley 80 sliding on a rail 81. The sliding door also may be supported by and slide on a roller and track combination. The lower edge of the door 13 may be guided by stakes 82 driven into the ground or by a pulley and rail or a roller and track combination.

The spur gear 18 continuously brings an outward pressure to bear on the gear rack 19. Such continuous pressure is created by one or more coil springs or resilient means 90 affixed to and between the top plate 21 of the stationary frame 15 and the back plate 33 of the sliding frame 30 to which the spur gear 18 is affixed. The coil springs 90 are affixed in holes 91 formed in the top plate 21 and back plate 33.

An automatic switching means 100 is affixed to the sliding frame 30. The switching means 100 turns off the motor 40 when the door 13 has been opened or closed to a desired position. Switching means 100 includes a slotted guide bar 101 bolted to the lower plate 32. A pair of switch operators 102 extend through the slotted guide bar 101 and include and are supported by a pair of respective threaded nuts 103 cooperating with the threaded portion 64 of the shaft 62. As the shaft 62 rotates, the nuts 103 are drawn up or down the threaded shaft portion 64 and the switch operators 102 slide up or down in the slot of the guide bar 101 so as to trip micro-switches 104, 105 bolted to the guide bar 101. One of the micro-switches 104, 105 turns off the motor 40 by one of the switch operators 103 when the door reaches its closed position. The other of the micro-switches 104, 105 shuts off the motor 40 by operation of the other switch operator 103 when the door reaches its open position. The width of the door 13 may determine the vertical distance between the micro-switches 104, 105.

The gear and motor arrangement 17 may comprise one or more of the switch means 100, the motor 40, shafts 41, 46, 53, 62, the pulleys 42, 45 and belt 43, sprockets 50, 52 and chain 51, the spur gears 18, 60 and gear rack 19, and sliding frame 30. The pulleys 42, 45, sprockets 50, 52, and spur gears 18, 60 are geared down for power. The motor 40 and switch means 100 are typically electrically connected to an accessible ground level manual switch 106 for turning on the motor 40. Alternatively, the motor 40 may be switched on by remote control.

In operation, to open the sliding door 13, the electrical motor 40 is turned on such as by the ground level switch 106 to operate the spur gear 18 through the pulleys 42, 45 and belt 44, sprockets 50, 52 and chain 51, and spur gear 60. The spur gear 18 then drives the gear rack 19 and slides the door 13 toward an open position. As the door 13 slides open, the spur gear 18 continuously brings a transverse outer pressure to bear on gear rack 19 via the coil springs or resilient means 90 exerting an outer transverse pressure on the sliding frame 30 relative to the stationary frame 15. When the door 13 is blown outwardly relative to the shed 14 by the wind, the coil springs 90 slide the sliding frame 30 and its gear and motor arrangement 17 outwardly with the door 13, thereby maintaining pressure on the gear rack 19 by the spur gear 18 and a meshing relationship between the rack 19 and gear 18. When the door 13 is blown inwardly toward the shed 14, the gear rack 19 brings pressure to bear on the spur gear 18 and slides the sliding frame 30 and its gear and motor arrangement 17 inwardly while maintaining a meshing and driving relationship between the gear 18 and rack 19. As the spur gear 18 and its shaft 62 rotate, the switch operators 102 are drawn on the threaded shaft portion 64 toward one of the micro-switches 104, 105. As the door 13 reaches its open position, and perhaps exposing the door frame 13 if the gear rack end portion 72 is utilized, one of the switch operators 102 trips one of the micro-switches 104, 105 to shut off the motor 40. A farm implement then may be driven out of the shed. When motor 40 is off, the coil springs 90 maintain the spur gear 18 against the gear rack 19 even if the wind flops the door 13 back and forth against the shed 13. When the door 13 is to be closed, the process is simply reversed.

It should be noted that the sliding door operator 10, including a rack 19, may be affixed to a bottom portion of the door frame 12. A pulley and rail combination similar to the pulley 80 and rail 81 or a roller and track combination may also be affixed to bottom portions of the door and structure. It has also been contemplated that the door operating means 10, including the rack 19, may include a worm and worm gear or a chain and sprocket mechanism.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A door operator for opening a sliding door of a structure comprising a stationary frame for being affixed to the structure, door operating means for opening and closing the sliding door and being mounted on the frame and transversely slidable relative the door, engaging means affixed in the door for engaging and cooperating with the door operating means, and resilient means affixed between the frame and the door operating means for continuously biasing the door operating means against the engaging means whereby the door operating means continuously brings pressure to bear against the engaging means when the door is wind driven inwardly or outwardly relative to the structure.

2. The door operator of claim 1, wherein the stationary frame includes a transverse channel and wherein the door operating means includes a support plate to which the door operating means is affixed, the support plate slidable in the channel so that the door operating means slides transversely with the door relative to the stationary frame.

3. The door operator of claim 1, wherein the resilient means includes a coil spring.

4. The door operator of claim 1, wherein the engaging means includes a rack affixed in the door and wherein the door operating means includes a toothed gear for cooperating with the rack.

5. The door operator of claim 4, wherein the rack is set in the door so as to lie substantially flush with the inside face of the door.

6. The door operator of claim 4, wherein the rack extends partially from each end of the door so that the rack has a greater length than the door whereby the door is completely openable.

7. The door operator of claim 4, wherein the rack is affixed in a top portion of the door.

8. The door operator of claim 4, wherein the door operating means includes a gear and motor arrangement with at least one other rotary gear, the toothed gear being of a greater diameter than the other gear so that the toothed gear is geared down for power relative to the motor.

9. The door operator of claim 4, wherein the door operating means includes a switch means for automatically turning off the door operator, the switch means comprising a threaded shaft affixed to the toothed gear, a switch operator threaded on the threaded portion, a slotted guide bar affixed to the door operating means, the switch operator extending through the slotted guide bar, and a guide with a threaded operator and two opposing switches, the threaded operator riding on a threaded portion in a first direction as the door is opened and in a second direction when the door is closed so as to be bearable against each of the switches.

10. A door operator for opening a sliding door of a structure having a door frame with an upper corner, comprising a stationary frame rigidly affixed in the upper corner of the door frame, the frame being generally U-shaped with a top plate and a pair of side plates, each of the side plates having a U-channel, the U-channels extending toward each other, the side plates being connected by a rod to maintain the side plates at a given distance from each other, a gear and motor arrangement for opening and closing the door and being slidable in the stationary frame, the arrangement including a sliding frame having upper and lower plates and a back plate, the upper plate mounted in the U-channels and supporting the arrangement relative to the stationary frame, the arrangement including a motor affixed to the back plate and a toothed gear affixed to the upper and lower plates, a rack affixed in the sliding door and extending beyond the ends of the door so that the door may be fully opened and closed relative to the door frame, and a coil spring affixed to and between the top plate of the stationary frame and the back plate of the sliding frame so as to continuously push the tooth gear against the gear rack when wind flops the sliding door back and forth relative to the structure.

* * * * *